US009341137B2

(12) United States Patent
Leitl

(10) Patent No.: US 9,341,137 B2
(45) Date of Patent: May 17, 2016

(54) PISTON FOR AN INTERNAL COMBUSTION ENGINE

(75) Inventor: Markus Leitl, Remshalden (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 14/130,518

(22) PCT Filed: Jul. 4, 2012

(86) PCT No.: PCT/DE2012/000667

§ 371 (c)(1),
(2), (4) Date: Jan. 24, 2014

(87) PCT Pub. No.: WO2013/004212

PCT Pub. Date: Jan. 10, 2013

(65) Prior Publication Data

US 2014/0130767 A1 May 15, 2014

(30) Foreign Application Priority Data

Jul. 4, 2011 (DE) ..... 10 2011 106 379

(51) Int. Cl.
*F02F 3/20* (2006.01)
*F02F 3/22* (2006.01)

(52) U.S. Cl.
CPC ..... *F02F 3/22* (2013.01)

(58) Field of Classification Search
CPC ..... F02F 3/22; F02F 3/003; F02F 3/00; F02F 3/16; F16J 1/09
USPC ..... 123/41.35, 193.6; 92/186; 29/888.04, 29/888.042
See application file for complete search history.

(56) References Cited

U.S. PATENT DOCUMENTS 491,421 A * 2/1893 Gersdorff ..... B67C 11/02 137/550
1,157,347 A 10/1915 Ver Planck
1,744,250 A * 1/1930 Trechsel ..... 123/41.35
3,221,718 A * 12/1965 Isley ..... F01P 3/08 123/193.6
4,067,307 A * 1/1978 Hofle ..... F01P 3/08 123/41.35
4,614,150 A * 9/1986 Deutschmann ..... 92/221

(Continued)

FOREIGN PATENT DOCUMENTS

DE 103 46 819 A1 4/2005
DE 10 2006 056 013 A1 5/2008

(Continued)

OTHER PUBLICATIONS

DE 102009056922 A1 translation.*

(Continued)

*Primary Examiner* — Marguerite McMahon
*Assistant Examiner* — Tea Holbrook
(74) *Attorney, Agent, or Firm* — Collard & Roe, P.C.

(57) ABSTRACT

The present invention relates to a piston (10) for an internal combustion engine, comprising a piston head (11) and a piston skirt (16), with a cooling channel (15) arranged in the piston head (11) and with at least one bore (17) opening into the cooling channel (15), a conduit (18) for a cooling oil jet (A) being housed in the bore. According to the invention, a jet divider (19) is arranged at the first free end (18*a*) of the conduit (18) and, in the area of the second free end (18*b*) of the conduit (18), the outer lateral surface of conduit (18) has a contact surface (24) that lies, secured against torsion, against an inner surface (25) of the piston (10).

9 Claims, 3 Drawing Sheets

(56) References Cited

U.S. PATENT DOCUMENTS

Figure 1:
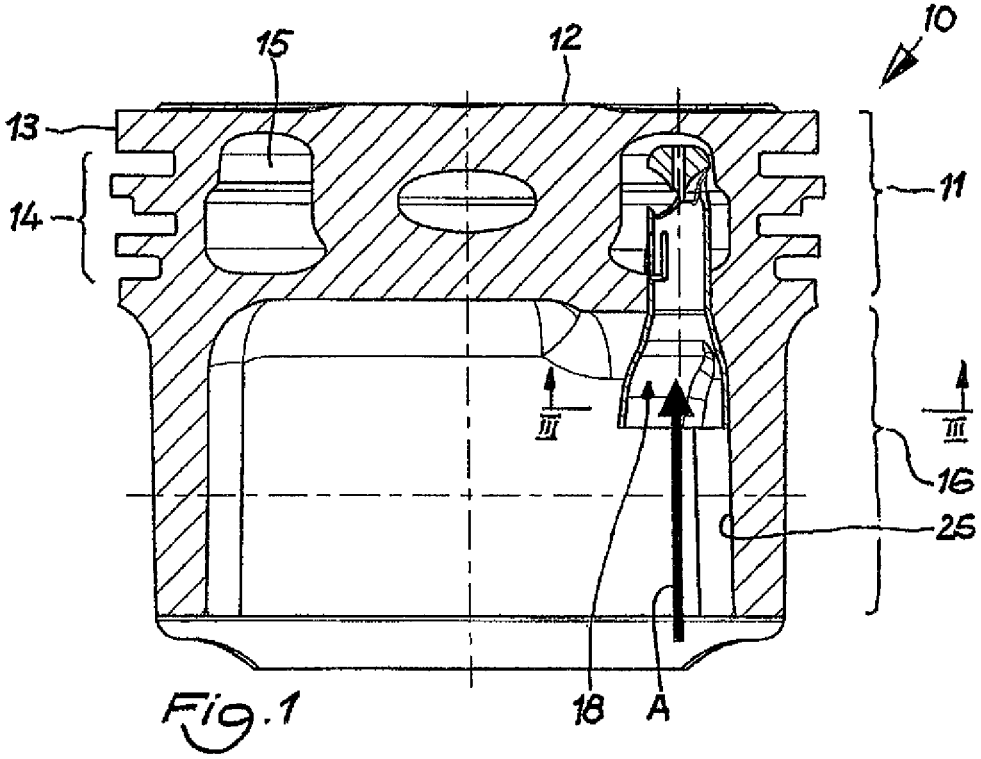

| | | | | |
|---|---|---|---|---|
| 6,032,619 | A * | 3/2000 | Zhu | F02F 3/003 123/41.35 |
| 6,472,635 | B2 * | 10/2002 | Trinkner | B23K 9/1006 219/133 |
| 6,722,263 | B2 * | 4/2004 | Keller | F02F 3/22 285/921 |
| 7,051,684 | B2 * | 5/2006 | Bauer | F02F 3/22 123/41.35 |
| 7,409,903 | B2 * | 8/2008 | Scharp | F02F 3/22 92/186 |
| 7,603,977 | B2 * | 10/2009 | Heidrich et al. | 123/193.6 |
| 2002/0178910 | A1 * | 12/2002 | Keller | F02F 3/22 92/208 |
| 2007/0039460 | A1 * | 2/2007 | Scharp | F02F 3/22 92/186 |
| 2008/0041491 | A1 * | 2/2008 | Salani | B67C 11/02 141/337 |
| 2009/0088836 | A1 * | 4/2009 | Bishop | A61F 2/2418 623/2.1 |
| 2009/0288618 | A1 * | 11/2009 | Issler | F02F 3/0015 123/41.35 |
| 2010/0186232 | A1 * | 7/2010 | Ootsuki et al. | 29/888.04 |
| 2011/0185992 | A1 * | 8/2011 | Gniesmer | B23P 15/10 123/41.39 |
| 2011/0214782 | A1 * | 9/2011 | McGeary | B67C 11/00 141/337 |

FOREIGN PATENT DOCUMENTS

| | | | | |
|---|---|---|---|---|
| DE | 10 2008 034 430 | A1 | 5/2010 | |
| DE | 10 2009 056 922 | A1 | 6/2011 | |
| DE | 102009056922 | A1 * | 6/2011 | F02F 3/22 |
| DE | 10 2010 012 119 | A1 | 9/2011 | |
| GB | 130 832 | A | 8/1919 | |
| GB | 1466575 | A * | 3/1977 | B21C 23/007 |
| JP | S56-124650 | A | 9/1981 | |
| JP | 2005-090448 | A | 4/2005 | |
| JP | 2008-240609 | A | 10/2008 | |
| WO | 00/04286 | A1 | 1/2000 | |
| WO | 2010/009779 | A1 | 1/2010 | |

OTHER PUBLICATIONS

International Search Report of PCT/DE2012/000667, mailed Nov. 13, 2012.

German Search Report dated May 22, 2012 in German Application No. 10 2011 106 379.3 with English translation of the relevant parts.

* cited by examiner

PISTON FOR AN INTERNAL COMBUSTION ENGINE

CROSS REFERENCE TO RELATED APPLICATIONS

This application is the National Stage of PCT/DE2012/000667 filed on Jul. 4, 2012, which claims priority under 35 U.S.C. §119 of German Application No. 10 2011 106 379.3 filed on Jul. 4, 2011, the disclosures of which are incorporated by reference. The international application under PCT article 21(2) was not published in English.

The present invention relates to a piston for an internal combustion engine, having a piston head and a piston skirt, having a cooling channel disposed in the piston head, and having at least one bore that opens into the cooling channel, in which bore a guide tube for a cooling oil jet is accommodated.

Pistons having a cooling channel in which a guide tube for a cooling oil stream is accommodated are actually known, for example from WO 00/04286 A1. The cooling oil circulating in the cooling channel serves for cooling the piston. The cooling oil is generally sprayed into the at least one inflow bore in known manner, by means of at least one piston spray nozzle provided in the region of the crankcase. It is problematical, in this connection, that the cooling oil is sprayed into the cooling channel only at certain points, so that some regions in the piston are not cooled sufficiently.

The task of the present invention consists in further developing a piston of the stated type in such a manner that optimal distribution of the cooling oil in the cooling channel and thereby particularly effective cooling are achieved in the simplest and most cost-advantageous manner possible.

The solution consists in that a jet divider is disposed at the first free end of the guide tube, and that the outer mantle surface of the guide tube, in the region of the second free end of the guide tube, has a contact surface that lies against an inner surface of the piston in rotation-preventing manner.

The configuration according to the invention is characterized in that orientation of the jet divider is predetermined by the geometrical configuration of the guide tube at its second free end, so that complicated adjustment of the jet divider in the cooling channel becomes unnecessary. Instead, adjustment of the jet divider already takes place during installation of guide tube and jet divider, so that the position of the jet divider in the cooling channel is already predetermined, in terms of design, at the time of installation.

Advantageous further developments are evident from the dependent claims.

Preferably, part of the contact surface is configured as a slanted or conical shoulder, in order to additionally secure the axial seat of the guide tube in the bore.

The jet divider can have an opening disposed centrally, in order to guide a part of the cooling oil jet that is passed through the guide tube directly to the underside of the piston crown, in order to further optimize cooling of the piston. The diameter of the entry opening of the guide tube can amount to 1.5 to 2.5 times the diameter of the guide tube.

In a preferred further development, the jet divider has two guide surfaces that lie opposite one another and two support surfaces that lie opposite one another, by way of the latter of which the jet divider is connected with the first free end of the guide tube. This configuration allows particularly simple adjustment of the jet divider on the guide tube, outside of the piston.

Preferably, the guide surfaces of the jet divider are disposed in the cooling channel, after installation of the guide tube, in such a manner that the cooling oil jet is divided up in the circumference direction of the cooling channel. In this manner, particularly effective cooling of the piston is ensured. The guide surfaces can be configured to be convex, concave or level, and can be disposed above the center of the cooling channel.

In a further preferred embodiment, the guide tube has a circumferential, conical contact shoulder that extends radially outward and supports itself in the cooling channel in the region of the bore. In this way, the desired axial positioning of the guide tube in the piston can be ensured in simple manner.

To simplify installation in the piston, the guide tube can have at least two tongues that flex radially toward the inside.

Preferably, the guide tube and/or the jet divider are produced from a metallic material and/or a plastic. The selection of the material is dependent on the requirements in an individual case.

Figure 2:
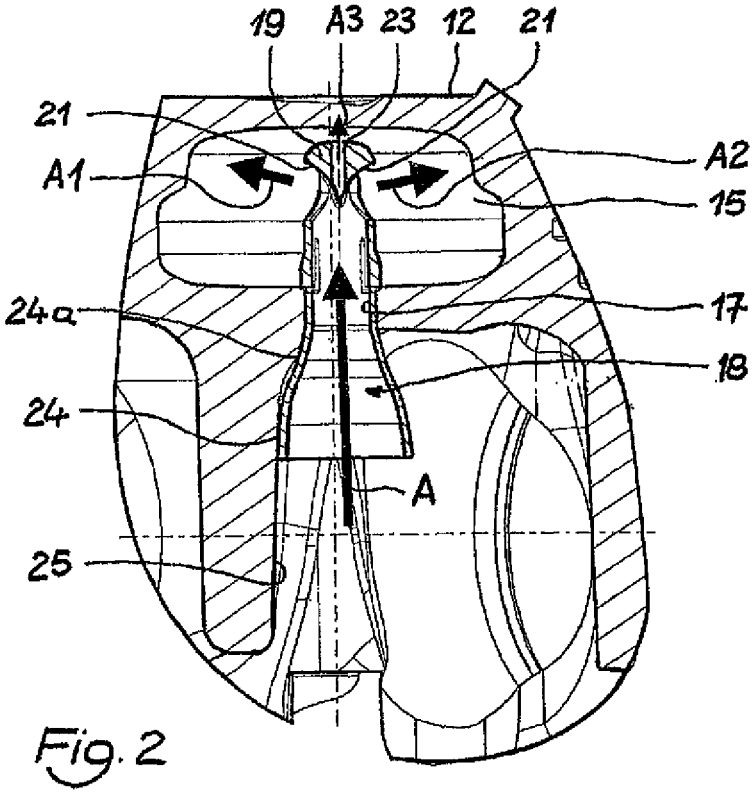
Figure 3:
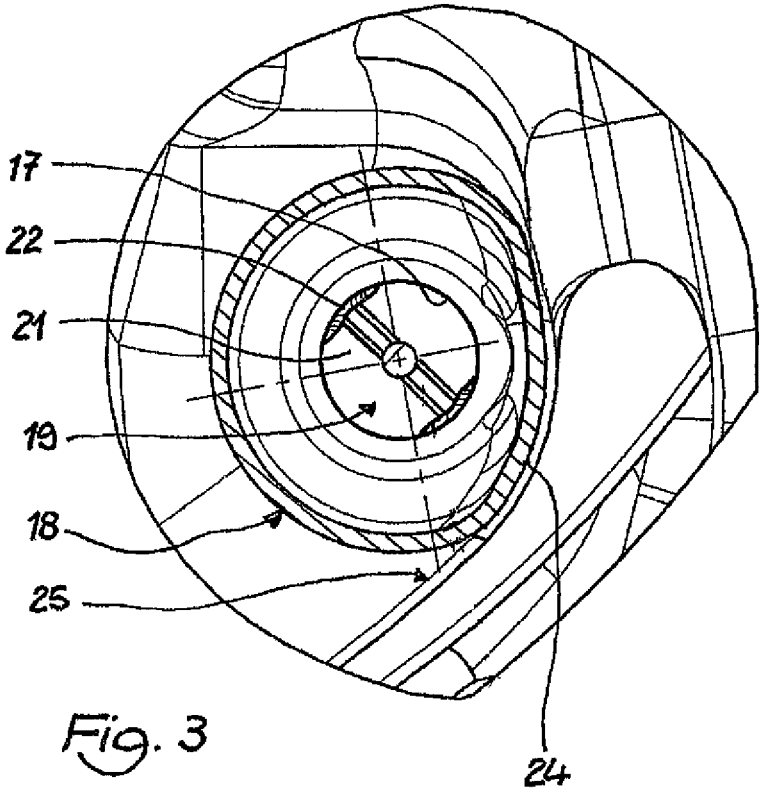
Figure 4:
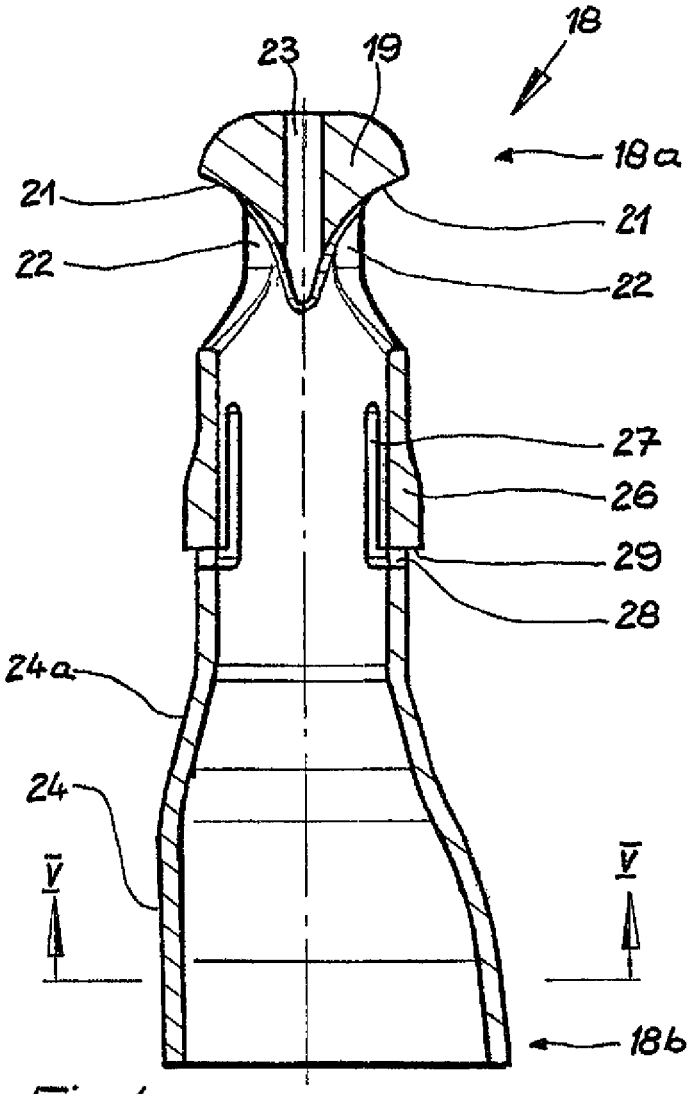
Figure 5:
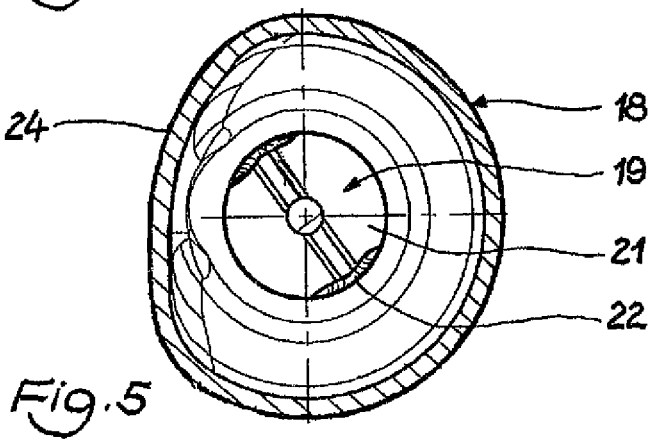

An exemplary embodiment of the present invention will be explained in greater detail below, using the attached drawings. These show, in a schematic representation, not true to scale:

FIG. 1 an exemplary embodiment of a piston according to the invention, in section;

FIG. 2 a detail view of the piston according to FIG. 1, in section, in a representation rotated by 180°;

FIG. 3 a section along the line III-III in FIG. 1;

FIG. 4 a detail view of a guide tube having a jet divider, for a piston according to the invention, in section;

FIG. 5 a section along the line V-V in FIG. 4.

FIGS. 1 to 3 show a piston 10 according to the invention, for an internal combustion engine, as an example. The piston 10, which is a single-part piston in the exemplary embodiment, has a piston head 11 with a piston crown 12, which can be provided, in known manner, with a combustion bowl (not shown). The piston crown 12 is followed by a circumferential top land 13 and a circumferential ring belt 14 having ring grooves for accommodating piston rings (not shown). A circumferential cooling channel 15 is provided in the region of the ring belt 14. The piston 10 furthermore has a piston skirt 16, in known manner.

The cylinder crankcase in which the piston 10 works is equipped, in known manner, with nozzles by means of which a cooling jet A is sprayed into a bore 17, which is structured essentially cylindrically in the exemplary embodiment. The bore 17 opens into the cooling channel 15 of the piston 10. A guide tube 18 is accommodated in the bore 17 in the direction of the piston spray nozzle (not shown).

In FIGS. 4 and 5, the guide tube 18 is shown larger. In the exemplary embodiment, the guide tube 18 is configured in sleeve shape and connected with a jet divider 19 at its first free end 18*a*. The jet divider 19 has two guide surface 21 that lie opposite one another for deflecting the cooling oil jet A within the cooling channel 15, and two support surfaces 22 that lie opposite one another. As can particularly be seen in FIG. 5, the jet divider 19 is connected with the first free end 18*a* of the guide tube 18 by way of its support surface 22. In the installed state (see FIGS. 2 and 3), the jet divider 19 is disposed within the cooling channel 15 in such a manner that the guide surfaces 21 divided the cooling oil jet A up into two partial jets A1 and A2, which are deflected in the circumference direction of the cooling channel 15, so that they circulate within the cooling channel 15. In the exemplary embodiment, the jet divider 19 furthermore has an axially oriented opening 23 disposed centrally. A further partial jet A3 of the cooling oil jet A is passed through this opening 23, in the axial direction, toward the top of the cooling channel 15 in the region of the piston crown 12, in order to further optimize cooling of the piston 10 (see FIG. 2).

According to the invention, the outer mantle surface of the guide tube 18 has a contact surface 24 in the region of its second free end 18*b*, which surface is configured in such a manner that it lies against an inner surface 25 of the piston 10 in rotation-preventing manner. The position and the shape of this inner surface 25 can be freely selected. In the exemplary embodiment, part of the contact surface 24 is configured as a conical, slanted shoulder 24*a*. The jet divider 19 is fastened onto the guide tube 18, before installation of the guide tube 18 in the bore 17, in such a manner that its guide surfaces 21 are oriented in such a manner, with reference to the contact surface 24 of the guide tube 18, that the partial jets A1 and A2 of the cooling jet A, which are generated by the guide surfaces 21, are deflected in the desired direction within the cooling channel 15, in the exemplary embodiment circulating in the cooling channel 15, during operation. This orientation of the jet divider 19 with reference to the contact surface 24 can be freely selected, so that the deflection of the cooling oil jet A can be adapted to individual requirements. The essential thing is that no further alignment of the jet divider 19 in the cooling channel 15 is required during installation of the guide tube 18 in the piston 10.

In the exemplary embodiment, installation of the guide tube 18 in the bore 17 takes place using at least two tongues 26 that flex radially inward. These tongues 26 are formed, in the exemplary embodiment, by axial slots 27, whereby two slots 27, in each instance, are connected with one another by means of a circumferential cut-out 28. To hold the guide tube 18 in the bore 17, a circumferential contact shoulder 29 that extends radially outward is provided, which is formed on the lower edge of the resilient tongues 26 and supports itself in the cooling channel 15 in the region of the bore 17. For installation, the guide tube is pushed through the bore 17 from the underside of the piston 10, in the axial direction. In this connection, the tongues 26 at first flex radially inward, so that the contact shoulders 29 formed on the tongues 26 can be passed through the bore 17. As soon as the contact shoulders 29 have been passed completely through the bore 17, the tongues 26 spring back radially outward, so that the contact shoulders 29 support themselves on the bottom of the cooling channel 15 and the guide tube 18 is held securely in the bore 17, in the axial direction. The interaction of the contact surface 24 of the guide tube 18 with the inner surface 25 of the piston 10, on the one hand, brings about the result that the guide tube 18 is held in the bore 17 of the piston 10 in rotation-preventing manner. The interaction of the slanted shoulder 24*a* of the contact surface 24 with the inner surface 25 of the piston 10, on the other hand, brings about the result that the guide tube 18 cannot be displaced upward in the axial direction, beyond a defined amount, so that the axial seat of the guide tube 18 is secured.

All of the components according to the invention can be produced from a metallic material or a plastic.

The invention claimed is:

1. Piston (10) for an internal combustion engine, having a piston head (11) and a piston skirt (16), having a cooling channel (15) disposed in the piston head (11), and having at least one bore (17) that opens into the cooling channel (15), in which bore a guide tube (18) for a cooling oil jet (A) is accommodated, wherein a jet divider (19) is disposed at the first free end (18*a*) of the guide tube (18), and wherein the outer surface of the guide tube (18), in the region of the second free end (18*b*) of the guide tube (18), has a contact surface (24) that lies against an inner surface (25) of the piston (10) in rotation-preventing manner, wherein said contact surface is configured so that a cross-section of the guide tube (18) that contains the contact, surface (24) is asymmetrical, wherein the guide tube (18) has at least two resilient tongues (26) that flex radially inward, and wherein a contact shoulder (29) is formed on the lower edge of said tongues (26), said contact shoulder extending radially outward and supporting itself in the cooling channel (15) in a region of the bore (17).

2. Piston according to claim 1, wherein part of the contact surface (24) is configured as a conical, slanted shoulder (24*a*).

3. Piston according to claim 1, wherein the jet divider (19) has a centrally disposed opening (23).

4. Piston according to claim 1, wherein the jet divider (19) has two guide surfaces (21) that lie opposite one another and two support surfaces (22) that lie opposite one another, by way of the latter of which the jet divider (19) is connected with the first free end (18*a*) of the guide tube (18).

5. Piston according to claim 4, wherein the guide surfaces (21) of the jet divider (19) are disposed in the cooling channel (15) in such a manner that the cooling oil jet (A) is divided up in the circumference direction of the cooling channel (15).

6. Piston according to claim 1, wherein the guide surfaces (21) of the jet divider (19) have a convex, concave or level shape.

7. Piston according to claim 1, wherein the jet divider (19), with its guide surfaces (21), is disposed above the center of the cooling channel (15).

8. Piston according to claim 1, wherein the guide tube (18) and/or the jet divider (19) are produced from a metallic material and/or a plastic.

9. Piston according to claim 1, wherein the diameter of the entry opening of the guide tube (18) amounts to 1.5 to 2.5 times the diameter of the guide tube (18).

* * * * *